US009884509B1

(12) United States Patent
Peattie

(10) Patent No.: US 9,884,509 B1
(45) Date of Patent: Feb. 6, 2018

(54) FINGER-MOUNTED MARKING APPARATUS

(71) Applicant: Christopher Peattie, Innisfil (CA)

(72) Inventor: Christopher Peattie, Innisfil (CA)

( * ) Notice: Subject to any disclaimer, the term of this patent is extended or adjusted under 35 U.S.C. 154(b) by 0 days.

(21) Appl. No.: 15/291,279

(22) Filed: Oct. 12, 2016

(51) Int. Cl.
*B43K 23/012* (2006.01)
*B43K 19/14* (2006.01)
*B43K 8/02* (2006.01)

(52) U.S. Cl.
CPC ..... *B43K 23/012* (2013.01); *B43K 8/02* (2013.01); *B43K 19/14* (2013.01)

(58) Field of Classification Search
CPC ..... B43K 23/012; B43K 19/14; B43K 8/02; B43K 23/00; B43K 23/001; B43K 23/004; B43K 23/008; B43K 23/016; B43K 29/00; B43K 29/10
See application file for complete search history.

(56) References Cited

U.S. PATENT DOCUMENTS 967,410 A * 8/1910 Montgomery ..... B43K 23/012 401/6
3,005,441 A 10/1961 Glasscock
3,596,964 A * 8/1971 Zazzara ..... B43K 23/012 224/217
5,944,433 A 8/1999 O'Mara et al.
5,971,642 A 10/1999 O'Mara et al.
6,540,421 B1 * 4/2003 Porcelli ..... B43L 15/00 401/131

* cited by examiner

*Primary Examiner* — David Walczak
(74) *Attorney, Agent, or Firm* — Stevenson IP, LLC

(57) ABSTRACT

A finger-mounted marking apparatus including a finger ring having a ring-shaped finger member and a substantially trapezoidal continuous upper member. A single substantially trapezoidal opening is disposed within the substantially trapezoidal continuous upper member of the finger ring from a rear surface to a front surface. A writing utensil is slidably and removably engageable within the single substantially trapezoidal opening. The ring-shaped finger member of the finger ring is selectively slidable on a finger of a wearer.

5 Claims, 4 Drawing Sheets

FINGER-MOUNTED MARKING APPARATUS

BACKGROUND OF THE INVENTION

Various types of marking devices are known in the prior art. However, what has been needed is a finger-mounted marking apparatus including a finger ring having a ring-shaped finger member and a substantially trapezoidal continuous upper member. What has been further needed is a single substantially trapezoidal opening disposed within the substantially trapezoidal continuous upper member of the finger ring from a rear surface to a front surface. Lastly, what has been needed is a writing utensil slidably and removably engageable within the single substantially trapezoidal opening, with the ring-shaped finger member of the finger ring selectively slidable on a finger of a wearer. The finger-mounted marking apparatus thus allows a wearer to make a mark on a work surface simultaneously with the measurement itself, since the wearer can now utilize both of his hands to make the measurement and will no longer require the assistance of a second person.

FIELD OF THE INVENTION

The present invention relates to marking devices, and more particularly, to a finger-mounted marking apparatus.

SUMMARY OF THE INVENTION

The general purpose of the present finger-mounted marking apparatus, described subsequently in greater detail, is to provide a finger-mounted marking apparatus which has many novel features that result in a finger-mounted marking apparatus which is not anticipated, rendered obvious, suggested, or even implied by prior art, either alone or in combination thereof.

To accomplish this, the present finger-mounted marking apparatus includes a finger ring, optionally plastic for durability, having a ring-shaped finger member and a substantially trapezoidal continuous upper member having a front surface, a rear surface, a pair of side sections attached to the ring-shaped finger member, and a top section disposed between each of the pair of side sections. It is envisioned that a circumference of the ring-shaped finger member will vary depending on a finger size of a wearer. Each of the pair of side sections is inwardly tapered from the top section to the ring-shaped finger member. A single substantially trapezoidal opening is disposed within the substantially trapezoidal continuous upper member of the finger ring from the rear surface to the front surface.

The finger-mounted marking apparatus further includes a writing utensil slidably and removably engageable within the single substantially trapezoidal opening. The writing utensil is optionally a carpenter pencil and, alternately, a marker, since both utensils are commonly used to mark a work surface with a measurement. The substantially trapezoidal shape of the opening provides a stronger engagement between the writing utensil and the opening. The ring-shaped finger member of the finger ring is selectively slidable on a finger of the wearer, which allows the wearer to easily mark a measurement on the work surface without the need to hold a measuring device within one of his pair of hands. The finger-mounted marking apparatus thus allows the wearer to hold the measuring device in his pair of hands to more accurately and quickly measure the work surface.

Thus has been broadly outlined the more important features of the present finger-mounted marking apparatus so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
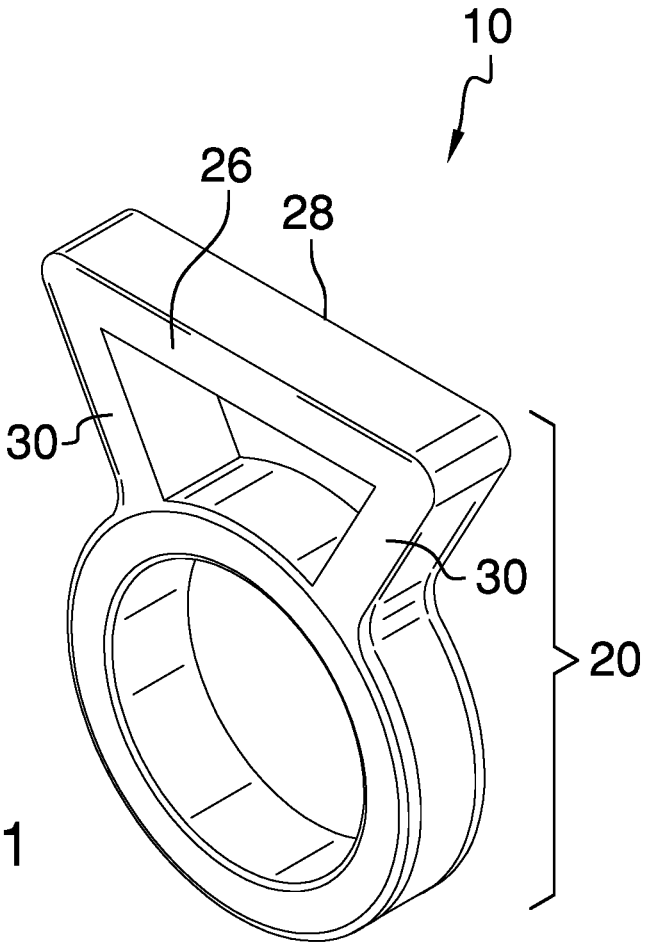
FIG. 1 is a front isometric view.
Figure 2:
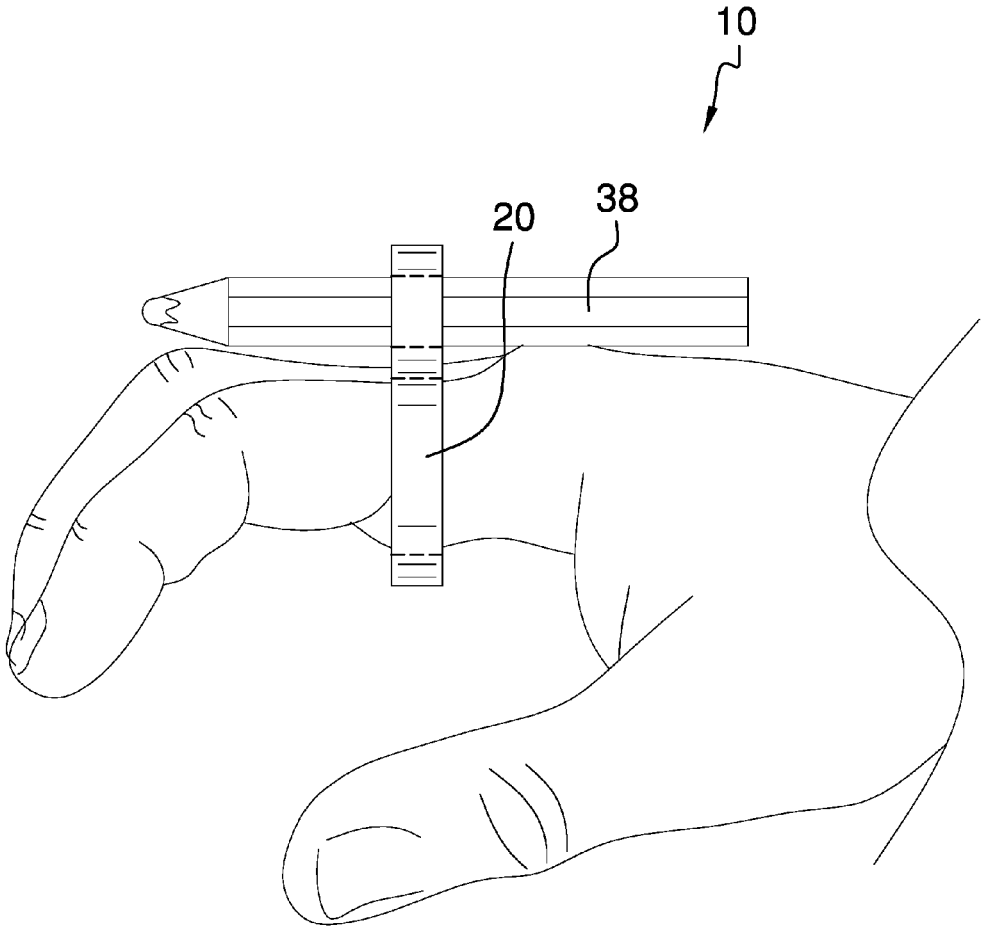
FIG. 2 is a side elevation view.
Figure 3:
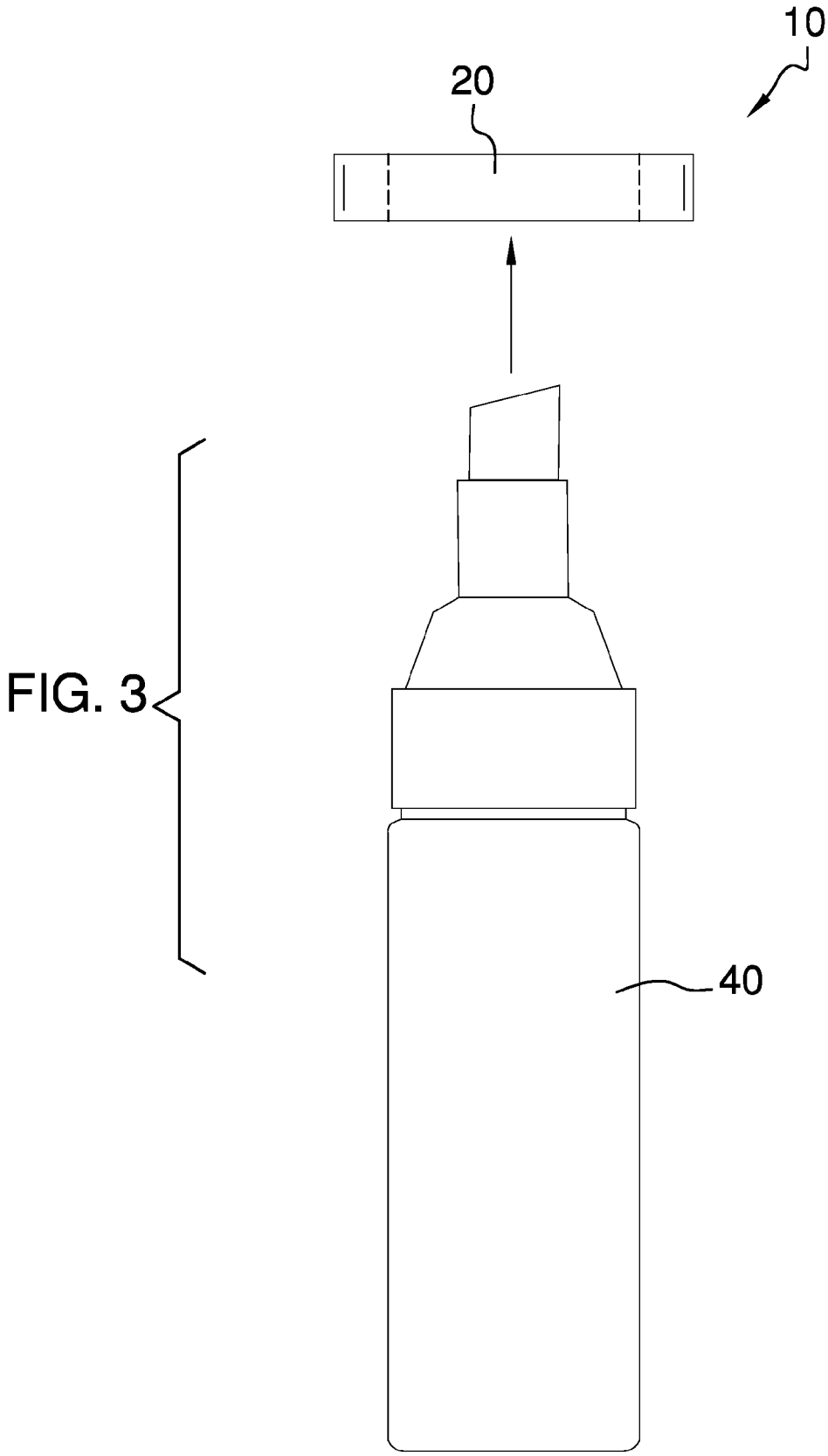
FIG. 3 is a top plan view.
Figure 4:
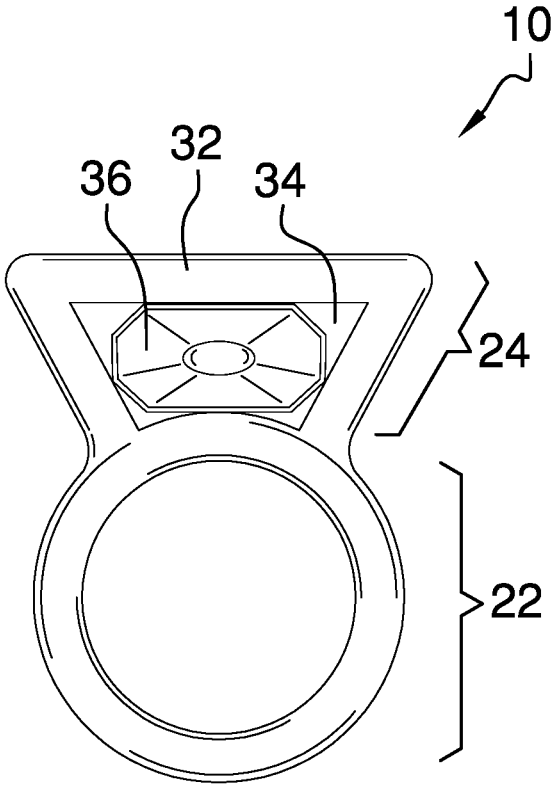
FIG. 4 is a front elevation view.

With reference now to the drawings, and in particular FIGS. 1 through 4 thereof, an example of the instant finger-mounted marking apparatus employing the principles and concepts of the present finger-mounted marking apparatus and generally designated by the reference number 10 will be described.

Referring to FIGS. 1 through 4 the present finger-mounted marking apparatus 10 is illustrated. The finger-mounted marking apparatus 10 includes a finger ring 20 having a ring-shaped finger member 22 and a substantially trapezoidal continuous upper member 24 having a front surface 26, a rear surface 28, a pair of side sections 30 attached to the ring-shaped finger member 22, and a top section 32 disposed between each of the pair of side sections 30. Each of the pair of side sections 30 is inwardly tapered from the top section 32 to the ring-shaped finger member 22. A single substantially trapezoidal opening 34 is disposed within the substantially trapezoidal continuous upper member 24 of the finger ring 20 from the rear surface 28 to the front surface 26.

The finger-mounted marking apparatus 10 further includes a writing utensil 36 slidably and removably engageable within the single substantially trapezoidal opening 34. The writing utensil 36 is optionally a carpenter pencil 38 and, alternately, a marker 40. The ring-shaped finger member 22 of the finger ring 20 is selectively slidable on a finger of a wearer.

What is claimed is:

1. A finger-mounted marking apparatus comprising:

a finger ring having a ring-shaped finger member and a substantially trapezoidal continuous upper member having a front surface, a rear surface, a pair of side sections attached to the ring-shaped finger member, and a top section disposed between each of the pair of side sections, wherein each of the pair of side sections is inwardly tapered from the top section to the ring-shaped finger member; and a single substantially trapezoidal opening disposed within the substantially trapezoidal continuous upper member of the finger ring from the rear surface to the front surface;

a writing utensil slidably and removably engageable within the single substantially trapezoidal opening;

wherein the ring-shaped finger member of the finger ring is selectively slidable on a finger of a wearer.

2. The finger-mounted marking apparatus of claim 1 wherein the writing utensil is a carpenter pencil.

3. The finger-mounted marking apparatus of claim 2 wherein the finger ring is plastic.

4. The finger-mounted marking apparatus of claim 1 wherein the writing utensil is a marker.

5. The finger-mounted marking apparatus of claim 4 wherein the finger ring is plastic.

* * * * *